United States Patent [19]

Sherman

[11] 4,238,051

[45] Dec. 9, 1980

[54] DISPENSER FOR PENS, PENCILS AND OTHER ELONGATED OBJECTS

[75] Inventor: Alan E. Sherman, University City, Mo.

[73] Assignee: Quick Point, Inc., Fenton, Mo.

[21] Appl. No.: 44,980

[22] Filed: Jun. 4, 1979

[51] Int. Cl.[3] ..... B65H 3/50

[52] U.S. Cl. ..... 221/205

[58] Field of Search ..... 221/202, 205, 289, 290, 221/298, 301, 256, 257, 188, 190

[56] References Cited

U.S. PATENT DOCUMENTS

| | | | |
|---|---|---|---|
| 1,229,982 | 6/1917 | Leonard | 221/202 |
| 1,436,749 | 8/1923 | Zeschar | 221/202 |
| 1,698,955 | 1/1929 | Lutfring | 221/205 |
| 1,843,233 | 2/1932 | Kaiser | 221/205 |
| 2,299,835 | 10/1942 | Mayer | 221/257 X |
| 2,434,514 | 1/1948 | Penn | 221/202 |
| 2,448,914 | 9/1948 | Roth | 221/188 X |
| 3,938,701 | 2/1976 | Jones | 221/202 X |

*Primary Examiner*—Stanley H. Tollberg

*Attorney, Agent, or Firm*—Gravely, Lieder & Woodruff

[57] ABSTRACT

A dispenser for pens and pencils as well as other elongated objects includes a housing in which the pens or pencils are placed. The housing has a discharge slot and contains a movable ramp which is inclined downwardly toward the discharge slot. Normally the ramp assumes an upper or hold position in which it blocks the discharge slot and prevents pens from rolling out of the housing. However, when the ramp is depressed by applying a force to an actuating tab that projects outwardly from it, the discharge slot is opened and a pen will roll out of the housing and onto retaining lips which form an outward continuation of the ramp. The housing further contains posts which are located immediately below the ramp when the ramp is in its upper position. However, when the ramp is depressed to its release position, the posts project upwardly through the ramp and prevent a succession of pens from rolling out of the discharge opening and onto the retaining lip. The posts further serve to agitate the pens approaching the discharge slot so as to prevent jams from developing at the discharge opening.

14 Claims, 7 Drawing Figures

DISPENSER FOR PENS, PENCILS AND OTHER ELONGATED OBJECTS

BACKGROUND OF THE INVENTION

This invention relates in general to dispensing devices and more particularly to a device for dispensing elongated objects such as pens and pencils.

While it is often convenient to store pens or pencils in a container from which they may be dispensed, it is difficult to dispense them one at a time from such a container on a gravity feed basis. The usual procedure is to dispense through a narrow space with the pens being urged to that space by gravity. The pens converge toward the space, which is only large enough to accommodate one of them, and as a consequence it is not uncommon for the pens to jam together and obstruct the space. Hence, most pencil dispensers heretofore developed are quite susceptible to jamming, and are therefore not widely used. Moreover, many dispensers heretofore developed do not dispense pens or pencils one at a time.

SUMMARY OF THE INVENTION

One of the principal objects of the present invention is to provide a pen or pencil dispenser which dispenses pens or pencils one at a time from a narrow opening, all on a gravity feed basis. Another object is to provide a dispenser of the type stated which has little tendency to jam. A further object is to provide a dispenser of the type stated which is attractive in appearance and economical to manufacture. An additional object is to provide a dispenser of the type stated in which the pens or pencils are easily and conveniently replaced in the dispenser for reuse. Still another object is to provide a dispenser of the type stated which serves as a convenient storage container for pens or pencils. Yet another object is to provide a dispenser of the type stated which is ideally suited for dispensing a wide variety of elongated objects in addition to pens and pencils. These and other objects and advantages will become apparent hereinafter.

The present invention resides in a dispenser including a housing that encloses a storage space and has a discharge opening. The dispenser further includes a ramp within the housing for supporting elongated objects in the storage space. The ramp moves from a hold position in which it blocks the discharge opening, to a release position in which it permits the elongated objects to pass out of the discharge opening. Posts project from the ramp when it is in the dispensing position to control the movement of elongated objects toward the discharge opening. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
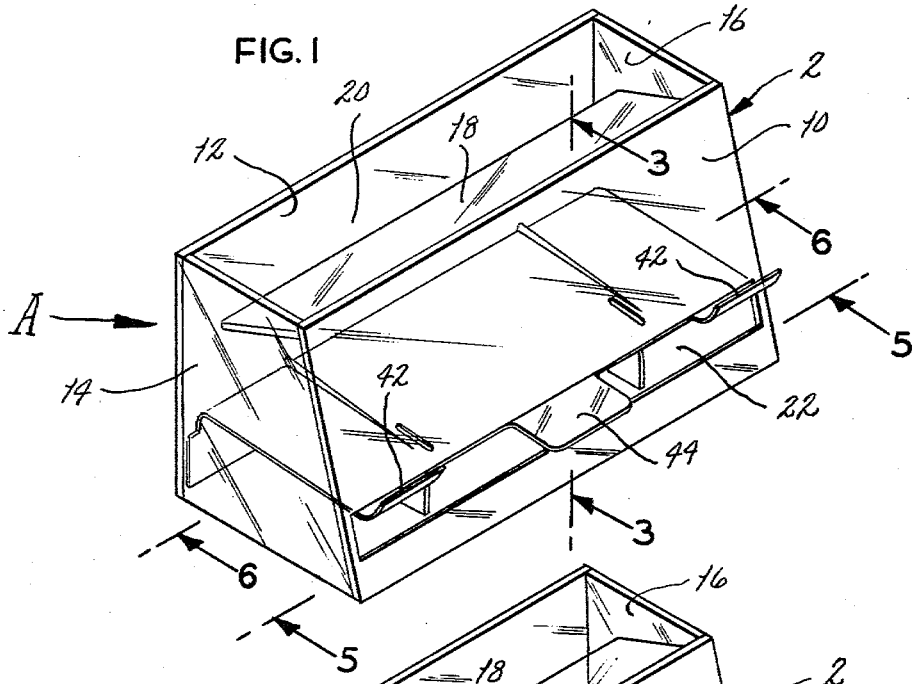
FIG. 1 is a perspective view of a dispenser constructed in accordance with and embodying the present invention.
Figure 2:
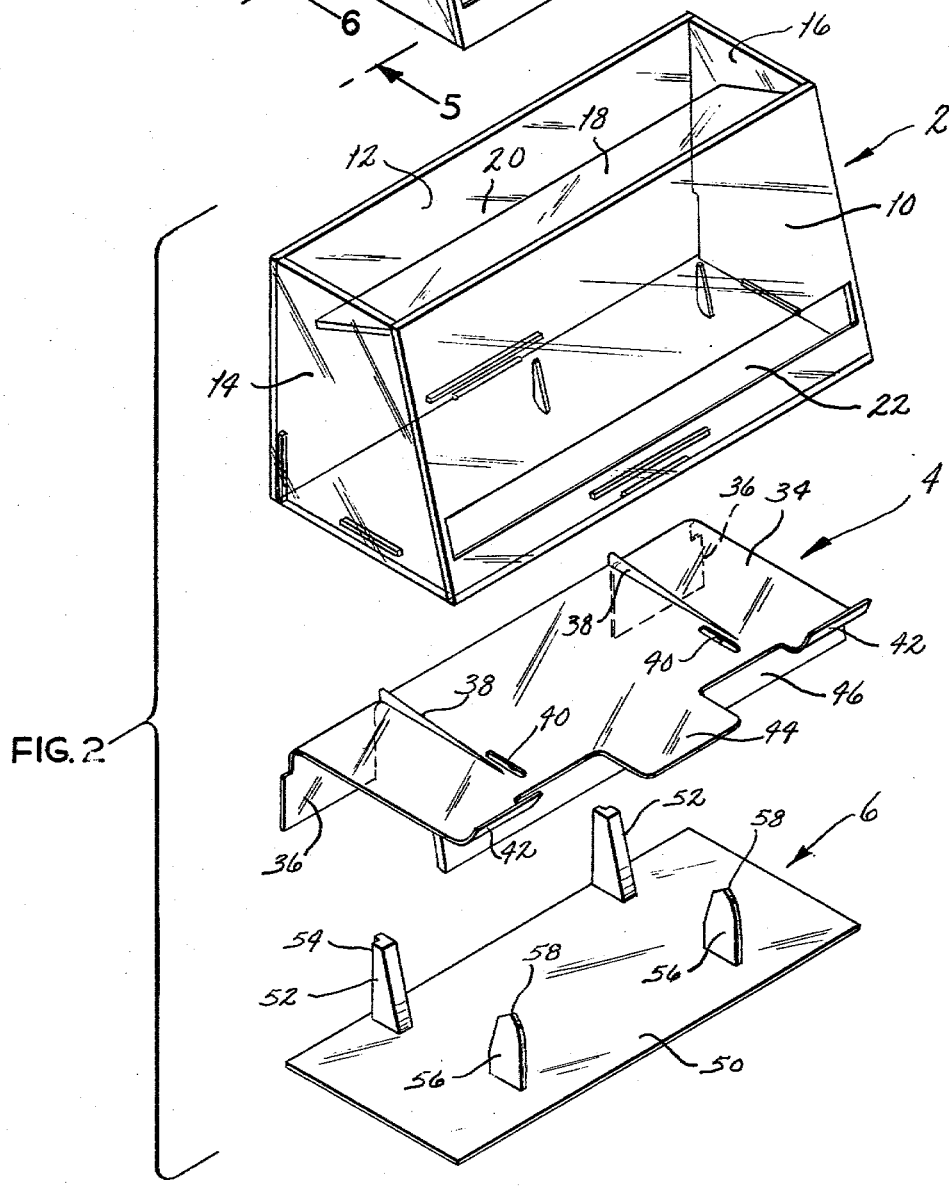
FIG. 2 is an exploded perspective view of the dispenser.

Referring now to the drawings (FIG. 1), A designates a dispenser which is suitable for dispensing pens or pencils P from a desk-top location. Indeed, the dispenser serves as a convenient holder for such pens or pencils, placing them within easy reach on the desk top and providing a convenient receptacle to which the pens or pencils may be returned. With the dispenser A, it is no longer necessary to open a desk drawer each time one needs a pen or pencil. The dispenser A includes (FIG. 2) three basic components, namely a housing 2, a dispensing tray 4, which is for the most part located within the housing 2, and a bottom closure 6 that closes the lower end of the housing and holds the tray 4 within the housing 2.

Figure 3:
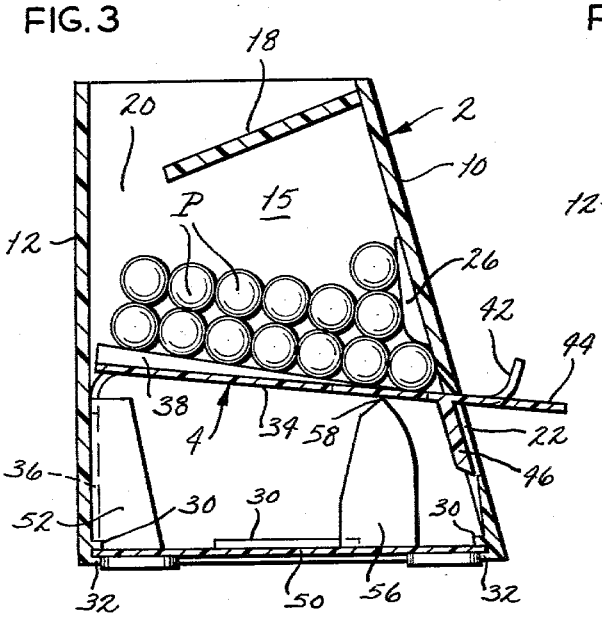
FIG. 3 is a sectional view taken along line 3—3 of FIG. 1 and showing the ramp of the dispenser in its upper or hold position.
Figure 4:
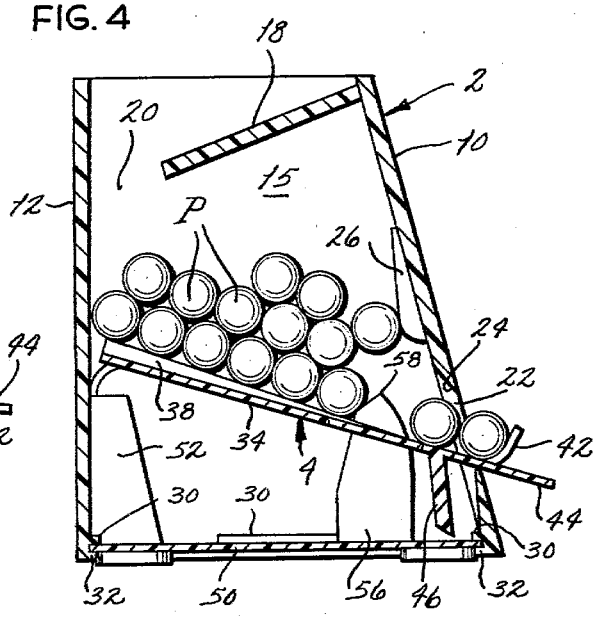
FIG. 4 is a sectional view similar to FIG. 3, but showing the ramp in its lower or release position and a pen discharged onto its retaining lips.

Considering first the housing 2, it includes (FIG. 2) front and rear walls 10 and 12, and left and right side walls 14 and 16, all of which are joined together to enclose a storage space 15 (FIGS. 3 & 4). The two side walls 14 and 16 are parallel and spaced far enough apart to easily accommodate a pen P between them. Moreover, the side walls 14 and 16 are perfectly upright, as is the rear wall 12 which is joined firmly to the side walls 14 and 16 at right angles. Unlike the other three walls 12, 14, and 16, the front wall 10 slopes such that its upper margin is located slightly closer to the rear wall 12 than its lower margin.

The top of the housing 2 is partially closed by a top wall 18 (FIGS. 2–4) which fits between the two side walls 14 and 16 and slopes downwardly away from the front wall 10. Indeed, the top wall 18 is joined firmly to the front wall 10 and to the two side walls 14 and 16 to create a tray for receiving pens once they are no longer needed. The rear margin of the top wall 18 is spaced forwardly from the rear wall 12, providing an entry slot 20 that opens into the storage space 15 and is wide enough to receive a pen P. Thus, a pen P that is placed onto the tray formed by the top wall 18 will drop into the storage space 15.

The front wall 10 near its lower margin has a discharge slot 22 (FIGS. 1, 2 & 4) which, like the entry slot 22, is wide enough to accommodate a single pen P. Indeed, the discharge slot 22 is as wide as the storage space 15 between the two side walls 14 and 16 and as a consequence the front wall 10 may constitute two segments—one above the slot 22 and the other below the slot 22. Along the upper margin of the discharge slot 22, the front wall has a beveled surface 24 (FIGS. 2 & 3) which tapers back to the storage space 15, providing a knife-like edge along the slot 22. On its inwardly presented face, the front wall 10 has a pair of directing vanes 26 which project inwardly from it and into the interior of the housing 2. The vanes 26 have convex inwardly presented edges and are spaced above the beveled surface 24 a distance slightly greater than the diameter of one of the pens P.

The two sidewalls 16 and 18 adjacent to the rear wall 12 are provided with vertical grooves 28 (FIG. 7) which open into the interior of the housing 2. In addition, all four walls 10, 12, 14, and 18 on their inwardly presented surfaces have positioning ribs 30 (FIGS. 3, 4 & 6) which are parallel to the bottom margins of those walls, yet are set slightly higher. The bottom closure 6 fits against the positioning ribs 30 which serve to maintain it in the correct position at the bottom of the housing 2. Finally, the front and rear walls 10 and 12 have locking ribs 32 which are parallel to the positioning ribs 30, but nevertheless are spaced downwardly from the positioning ribs 30. The ribs 32 lie along the lower margins of the front and rear walls 10 and 12 and serve to retain the bottom closure 6 within the lower portion of the housing 2.

Figure 6:
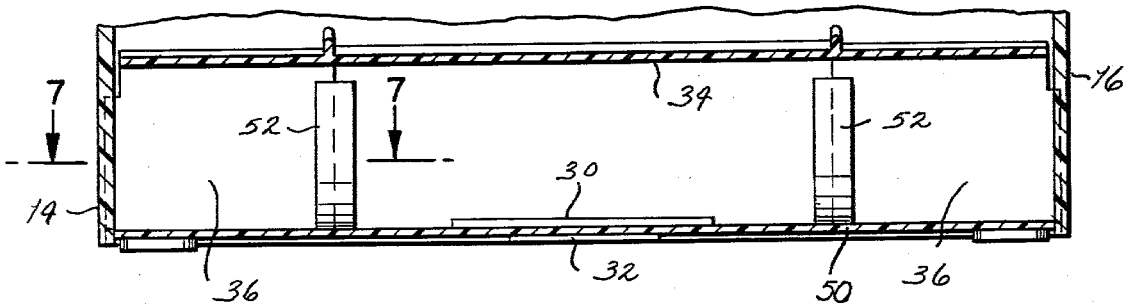
FIG. 6 is a sectional view taken along line 6—6 of FIG. 1 and showing the support legs of the dispensing tray.
Figure 7:
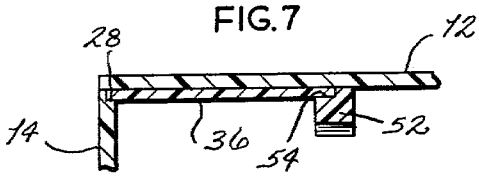
FIG. 7 is a sectional view taken along line 7—7 of FIG. 6 and showing the manner in which the supporting legs are interlocked with the housing and the mounting posts of the base.

The dispensing tray 4 constitutes an integral unit that includes a ramp 34 which forms the bottom of the storage space 15 and is inclined downwardly from the rear wall 12 to the upper margin of the discharge slot 22 in the front wall 10. The ramp 34 extends from the left side wall 14 to the right side wall 16, yet is not fitted so tightly between those side walls as to prevent it from moving upwardly and downwardly. Indeed, the fit is rather loose so that the ramp 34 is free to move between an upper or hold position (FIG. 3) and a lower or dispense position (FIG. 4). In the hold position, the forward portion of the ramp 34 is located along the upper margin of the discharge slot 22 in the front wall 10. In the dispense position, the forward portion of the ramp 34 is depressed to the lower margin of the slot 22, thereby opening the slot 22 and exposing the storage space 15 through it. Along its rear margin, the ramp 34 merges into a pair of supporting legs 36 (FIGS. 2–7) which extend downwardly along the inwardly presented face of the rear wall 12. Moreover, the legs 36 project laterally beyond the side margins of the ramp 34, with these portions of the legs 36 being received in the vertical grooves 28 of the side walls 14 and 16 (FIG. 7). This holds the legs in a generally fixed position with respect to the housing 2, even though the ramp 34 is free to move upwardly and downwardly within the housing 2. In this connection, the dispensing tray 4 is formed from a somewhat resilient material, such as polystyrene plastic, and the resiliency of this material is such that it enables the tray 4 to flex where the legs 36 merge into the ramp 34. In other words, the ramp 34 pivots about its juncture with the supporting legs 36 when it is moved between its hold and dispense positions, so the pivot axis is, generally speaking, located along the rear wall 12 of the housing 2. The natural resiliency of the material is such that the ramp 34 is urged upwardly into its hold position, so that unless otherwise disturbed, the ramp 34 closes the discharge slot 22 in the front wall 10. To prevent the ramp 34 from flexing intermediate its front and rear margins, rigidifying ribs 38 are extended along it, these ribs being set slightly inwardly from the supporting legs 36. The ribs 38 also reduce friction and allow the pens P to move more freely along it. The ramp 34 in addition contains a pair of elongated apertures 40 (FIGS. 2 & 5) which are set slightly inwardly from the rigidifying ribs 38 and have their major axes extended from front to rear, that is parallel to the rigidifying ribs 38.

The forward margin of the ramp 34 for the supporting tray 4 is located at the discharge slot 22 in the front wall, and projected from this margin at each end of the tray are retaining lips 42 (FIGS. 2–4) which initially assume the general inclination of the ramp 34, but thereafter turn upwardly. The turned-up portions of the lips 42 are spaced from the front wall 10 by a distance slightly greater than the diameter of a pen P. Between the two retaining lips 42 is an actuating tab 44 which likewise projects forwardly from the ramp 34 and assumes the general inclination of the ramp 34.

Finally, the tray 4 has a skirt 46 (FIGS. 2–4) which is attached to and projects downwardly from the lower surface of the ramp 34. The skirt 46 is set slightly rearwardly from the forward margin of the ramp 34 and is behind the discharge slot 22 which it obscures when the ramp 34 is in its upper or hold position. One can move the ramp 34 to its lower or release position merely by pressing downwardly on the actuating tab 44. This causes the dispensing tray 34 to flex at the upper ends of the supporting legs 36 and to open the discharge slot so that the storage space 15 of the housing 2 is exposed through the discharge slot 22.

Figure 5:
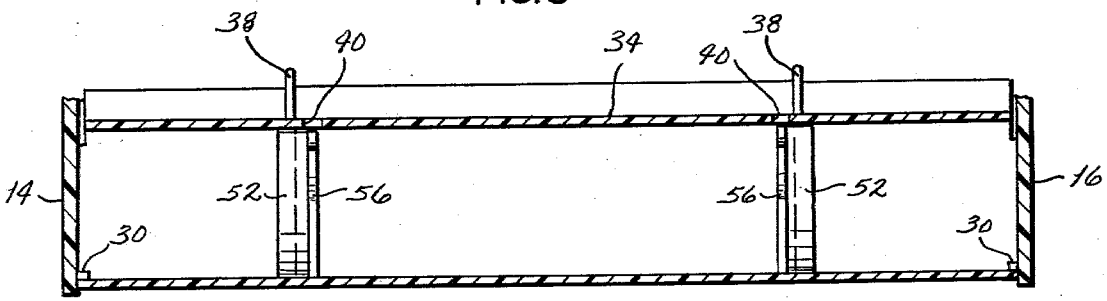
FIG. 5 is a sectional view taken along line 5—5 of FIG. 1 and showing the control posts.

The bottom closure 6 includes a bottom wall 50 (FIGS. 2–6) which fits against the positioning ribs 30 on the front, rear, and side walls 10, 12, 14 and 16 and thereby closes the lower portion of the housing 2. The bottom wall 50 is retained in place by the locking ribs 32 (FIGS. 3, 4 & 6) inasmuch as the front and rear margins of the bottom wall 50 fit between the positioning ribs 30 and the locking ribs 32 of the front and rear walls 10 and 12. Thus, the bottom wall 50 is secured in a fixed position within the bottom of the housing 2. When so positioned, the lower margins of the two supporting legs 36 for the dispensing tray 4 bear against the bottom wall 50 so that the bottom wall 50 serves to position the tray 4, at least in the vertical direction, within the housing 2 (FIGS. 5 & 6). When the tray 4 is so position, the forward margin of the ramp 34 is along the upper margin of the discharge slot 22.

The bottom wall 50 of the closure 56 has a pair of positioning posts 52 (FIGS. 2–7) projecting upwardly from it adjacent to its rear margin, and these posts have rabbets 54 (FIG. 7) that extend vertically and receive the inside edges of the supporting legs 36, thereby preventing those edges from moving forwardly when the dispensing tray 4 flexes at the juncture between its ramp 34 and legs 36. In effect, the positioning posts 52 serve to confine the inside edges of the legs 36, while the grooves 28 in the side walls 14 confine the outside edges.

The bottom wall 50 is further provided with a pair of control posts 56 (FIGS. 2–5) which project upwardly from it and align with the elongated apertures 40 in the ramp 34. However, when the ramp 34 is in its upper or hold position, the posts 56 are located entirely below the elongated apertures (FIG. 3). When the ramp 34 is depressed and moved to its lower or dispense position, the ramp 34 moves downwardly over the control posts 56 which are accommodated in the elongated apertures 40 (FIG. 4). Hence when the ramp 34 is in its dispense position, the lower ends of the posts 56 project through the elongated apertures 40 and above the upper surface of the ramp 34. The upper ends on each post 56 are beveled to a point 58, or more particularly the upper ends of the posts are V-shaped with the apex of the V projecting upwardly toward the top wall 18 of the housing 2.

OPERATION

In use, the pens P are loaded into the dispenser A merely by placing them onto the top wall 18 of the housing 2 and allowing them to roll downwardly to the entry slot 22. The pens P drop through the entry slot 22, whereupon they fall downwardly into the storage space 15 where they are supported on the ramp 34 of the dispensing tray 4. Once the ramp 34 is completely covered with pens, additional pens accummulate on top of those already on the ramp 34 so that a large supply of pens P may be accommodated within the storage space 15 of the housing 2. Even when the space 15 is completely filled with pens P, the weight of those pens P is not enough to overcome the natural resiliency of the material from which the dispensing tray 4 is formed, so that the ramp 34 remains in its hold position (FIG. 3).

To retrieve a pen P from the dispenser A, one need only press downwardly upon the actuating tab 44 with sufficient force to move that tab downwardly to the lower margin of the discharge slot 22 (FIG. 4). This opens the slot 22 and allows a single pen P to roll outwardly onto the retaining lips 42. In this connection, the ramp 34 and front wall 10 converge at an acute angle, and at the apex of this convergence is enough space to accommodate a single pen P. This space is located immediately below the directing vanes 26 and immediately ahead of the points 58 on the upper ends of the control posts 58. When the ramp 34 is depressed, the single pen within the space ahead of the control posts 58 rolls forwardly onto the retaining lips 42. In many instances, the posts 56 appear immediately behind the first pen P and prevent the next pen P in the succession from rolling outwardly and thereby creating a jam at the discharge slot 22. In other words, as the ramp 34 descends, the control posts 56 project upwardly above it and engage the second pen P, thereby preventing that pen from rolling onto the retaining lips 42 immediately behind the first pen P. The directing vanes 26 serve a similar function in that they prevent any pens P which may be stacked above the second pen from rolling down over that pen and onto the retaining lips 42. When the actuating tab is released, the ramp again rises above the posts 56, whereupon the second pen P is released and moves down into the area formed by the converging ramp 34 and front wall 10, so that the second pen P now becomes the first pen P and will be dispensed the next time that the actuating tab 44 is depressed.

Should a second pen P drop into the converging area behind the first pen P (FIG. 4), it will remain inside the housing 2 since the retaining lips 42 are wide enough to accommodate only a single pen P. Of course, the first pen P cannot be retrieved from the lips 42 until the actuating tab 44 is released, at least if only one hand is used, which is the normal case. Thus, when the actuating tab 44 is released, the ramp 34 rises back to its hold position under the natural resiliency of the material from which the tray 4 is formed. In so doing, the second pen P comes against the beveled surface 24 along the front wall 10 and is in effect cammed back into the storage space 15 of the housing 2.

Not only do the control posts 56 prevent more than one pen P from being dispensed when the actuating tab 44 is depressed, but they further serve to agitate the pens P within the storage space 15 of the housing and thereby prevent those pens P from jamming at the discharge slot 22.

This invention is intended to cover all changes and modifications of the example of the invention herein chosen for purposes of the disclosure which do not constitute departures from the spirit and scope of the invention.

What is claimed is:

1. A dispenser for elongated objects such as pens, pencils, and the like, said dispenser comprising: a housing having front, rear, side and top walls that are joined together to enclose a storage space capable of holding a plurality of the elongated objects, the housing also having an entry opening through which elongated objects may be introduced into the storage space, the front wall having a discharge slot, with the slot being large enough to accommodate the elongated objects generally one at a time, the top wall forming a fixed tray that is large enough to accommodate an elongated object and is inclined downwardly toward an entry opening so that an elongated object which is placed on the tray will roll to the opening and drop into the storage space; a ramp located within the housing and forming the lower surface of the storage space, the ramp being inclined downwardly toward the front wall and having its upper surface generally unobstructed from the rear of the storage area to the front of the storage area so that the elongated objects will migrate to the front of the ramp without being impeded, the ramp along its rear margin further being pivoted with respect to the housing such that it will move from a hold position, wherein the forward end of the ramp blocks the slot in the front wall of the housing and prevents the discharge of elongated objects from that slot, to a release position, wherein the ramp permits elongated objects to pass out of the slot; means for urging the ramp to its hold position with sufficient force to enable the ramp to normally assume that position; means at the forward end of the ramp for supporting an elongated object such that it can be easily retrieved from the ramp, said means being projected beyond the discharge slot in the front wall of the housing so as to be accessible from outside the housing, whereby an elongated object will roll onto the supporting means when the ramp is moved to its release position; and control posts mounted in a fixed position within the housing such that they are located entirely below the ramp when the ramp is in its hold position, but when the ramp is moved to its release position the posts project through the ramp to agitate the elongated objects in the storage area and thereby prevent jams and to further control the movement of objects to the discharge slot.

2. A dispenser according to claim 1 wherein the posts are located adjacent to the discharge slot in the front wall of the housing.

3. A dispenser according to claim 2 wherein the ends of the control posts are pointed and directed upwardly.

4. A dispenser according to claim 3 wherein the pointed ends of the control posts are set rearwardly from the front wall a distance sufficient to enable a single elongated object to fit between the front wall and the posts as the ramp is moved to its release position.

5. A dispenser according to claim 4 wherein the front wall is essentially flat and has at least one protuberance located above and projected generally toward the upper ends of the posts.

6. A dispenser according to claim 1 and further comprising supporting legs formed integral with the ramp and secured against the rear wall generally in a fixed position within the housing, and wherein the material from which the ramp and supporting legs are formed possesses sufficient flexibility to enable the ramp to pivot generally at the juncture between the ramp and support legs and further possesses sufficient resiliency to urge the ramp and normally retain it in its hold position.

7. A dispenser according to claim 1 wherein the means for supporting an elongated object at the front of the ramp is capable of supporting only a single elongated object beyond the front wall of the housing so that any other elongated objects on the ramp will remain in the storage space within the housing.

8. A dispenser according to claim 7 wherein the front wall of the housing is beveled along the upper edge of the discharge slot with the bevel being presented inwardly so that any elongated objects which are below that edge as the ramp returns from its release to its hold position will be deflected back into the storage space of the housing.

9. A dispenser according to claim 1 and further comprising an actuating tab projected from the ramp and extended through the discharge opening where it can be depressed to move the ramp from its hold position to its release position.

10. A dispenser according to claim 9 wherein the means for supporting an elongated object at the forward end of the ramp comprises retaining lips which project from the ramp beyond the discharge slot and are configured to hold and retain any elongated objects that pass from the ramp and through the slot.

11. A dispenser for elongated objects such as pens, pencils, and the like, said dispenser comprising: a housing having front and rear walls and side walls extended between the front and rear walls, all such that the housing encloses a storage space capable of holding a plurality of the elongated objects, the front wall of the housing having a discharge opening that is large enough to accommodate one of the elongated objects; a ramp located within the housing and extending generally between the front and rear walls for supporting the elongated objects thereon; supporting legs formed integral with the ramp and being engaged with the side walls of the housing such that the legs are positioned against the rear wall generally in a fixed position within the housing, the material from which the ramp and supporting legs is formed possessing sufficient flexibility to enable the ramp to pivot generally at the juncture between the ramp and the supporting legs such that the ramp is movable from a hold position, wherein the discharge opening is blocked and the elongated objects will not pass out of the housing, to a release position wherein the discharge opening is open sufficiently to permit an elongated object to pass out of the housing, the material further possessing sufficient resiliency to urge the ramp to and normally retain it in its hold position; and control posts mounted in a fixed position within the housing and being projected upwardly toward the ramp such that, when the ramp is in its hold position, the posts are completely below the ramp, but when the ramp is in its release position the posts project through the ramp.

12. A dispenser for dispensing elongated objects, said dispenser comprising: a housing having front, rear, and side walls that are joined together to enclose a storage space for holding the elongated objects, the front wall having a discharge slot in it, with the slot being large enough to accommodate the elongated objects generally one at a time; a ramp located in the housing and forming the lower surface of the storage space, the ramp being inclined downwardly toward the discharge slot; supporting legs formed integral with the ramp along the rear margin of the ramp and being fixed in position against the rear wall within the housing, the connection between the ramp and supporting legs being such that the ramp pivots along that connection from a hold position wherein it blocks the discharge of objects from the discharge slot to a release position wherein it permits the elongated objects to pass out of the discharge slot, the ramp being urged to its hold position; and control posts mounted in a fixed position within the housing such that they are located entirely below the ramp when the ramp is in the hold position, but when the ramp is moved to its release position the posts project through it and control the movement of elongated objects to the discharge slots.

13. A dispenser according to claim 11 and further comprising a bottom member at the lower end of the housing and fixed in position with respect thereto, and wherein the supporting legs are also engaged with the bottom member.

14. A dispenser according to claim 11 wherein the side walls have grooves and the supporting legs project laterally into the grooves.

* * * * *